United States Patent [19]

Saulters

[11] 4,092,506

[45] May 30, 1978

[54] THEFT PREVENTION SWITCH DEVICE

[76] Inventor: Cecil Clyde Saulters, 819 W. 27th St., Pueblo, Colo. 81003

[21] Appl. No.: 789,930

[22] Filed: Apr. 22, 1977

[51] Int. Cl.[2] ..... H01H 27/00

[52] U.S. Cl. ..... 200/42 R; 200/162; 200/281; 200/61.85; 200/61.93; 180/114; 340/63

[58] Field of Search ..... 200/42 R, 42 A, 162, 200/42 T, 271, 272, 281, 61.93, 61.85; 180/114; 307/10 AT; 123/198 B; 340/63, 64; 290/37 R

[56] References Cited

U.S. PATENT DOCUMENTS

| | | | |
|---|---|---|---|
| 604,874 | 5/1898 | Brougham et al. | 200/42 R |
| 1,071,169 | 8/1913 | Mertz et al. | 200/42 R |
| 1,192,400 | 7/1916 | Edison | 290/37 R |
| 1,261,091 | 4/1918 | Alcon | 200/42 R |
| 1,459,995 | 6/1923 | Saring | 200/42 R X |
| 1,898,370 | 2/1933 | Hughes et al. | 290/37 R |
| 2,243,741 | 5/1941 | Rowe | 200/162X |
| 2,607,837 | 8/1952 | Federuk | 340/63 |
| 2,644,864 | 7/1953 | Childs | 200/42 R X |
| 2,913,587 | 11/1959 | Gebhard | 290/37 R |
| 3,171,939 | 3/1965 | Ustin | 200/162 |
| 3,631,301 | 12/1971 | Goldman | 340/63 X |
| 3,777,306 | 12/1973 | Splickhoff | 180/114 X |
| 3,850,260 | 11/1974 | Obermeit | 180/114 |
| 3,902,075 | 8/1975 | Oros | 340/64 X |

FOREIGN PATENT DOCUMENTS

| | | | |
|---|---|---|---|
| 701,274 | 1/1965 | Canada | 200/162 |
| 860,448 | 1/1971 | Canada | 200/162 |
| 73,792 | 10/1944 | Czechoslovakia | 200/162 |
| 692,200 | 6/1940 | Germany | 200/162 |
| 375,946 | 7/1932 | United Kingdom | 200/162 |

*Primary Examiner*—Robert S. Ward, Jr.
*Attorney, Agent, or Firm*—Burton & Dorr

[57] ABSTRACT

A theft prevention switch device for use in a vehicle with an electrical system selectively operable off one of a plurality of battery sources. In the preferred embodiment, three electrical conducting means are attached to a support plate which can be mounted within a box that can be locked shut. One of the electrical means is connected to the vehicle's electrical system and each of the other two is connected to a battery source. The electrical conducting means are spaced from each other about a common point. A portable and removable plunger can be selectively placed to electrically connect the first electrical conducting means either to the second or the third electrical conducting means. The portable and removable plunger has two substantially planar portions joined at an angle and an insulated, cylindrical gripping member. The first electrical conducting means is spaced from each of the other two about a common common point at an angle corresponding to the angle between the planar portion of the plunger. The electrical system of the vehicle can be easily and quickly connected to either battery source by merely reversing the planar portion of the plunger received in the first electrical conducting means. The other planar portion of the plunger will then automatically be in alignment with either the second or third electrical conducting means.

34 Claims, 5 Drawing Figures

THEFT PREVENTION SWITCH DEVICE

FIELD OF THE INVENTION

This invention relates to the field of theft prevention devices for use in vehicles with electrical systems. The invention also relates to the field of switches for connecting an electrical system to a single battery source or to one of a plurality of battery sources.

BACKGROUND OF THE INVENTION AND PRIOR ART

Recreation vehicles such as jeeps, pickup trucks with campers, mobile homes, and the like are popular targets for theft. Such vehicles and their accessories are often very valuable and easy prey for a thief. Hunters and outdoorsmen who leave their vehicles for hours or days at a time on lonely roads are often surprised and shocked to find their vehicle gone when they return. Thefts occur not only in lonely, out-of-the-way places but also in crowded camping areas. No place is truly safe and no theft prevention device or procedure is totally effective. However, whatever devices or procedures can be used to make it harder and more time-consuming for a thief to steal the vehicle are well worth the cost and effort. Any additional obstacles the thief must overcome in order to steal the vehicle will tend to discourage him as time is one of a thief's major concerns.

The vast majority of vehicles have one battery source for their electrical systems; however, many vehicles, especially recreational vehicles, have dual battery sources. Most commercially available dual battery systems are not designed so that each battery can be selectively used to power either the vehicle or the accessories such as a camper. It appears that practically every owner of a vehicle-camper outfit is under the false impression that in the event that the vehicle's battery fails, the battery of the camper can be merely connected to the poles of the dead vehicle's battery with jumper cables to start the vehicle. In most commercially available vehicles, the end result of such a jumper connection is that not only is power not supplied to the vehicle's starter but the expensive charging system between the batteries is also completely burned out. Unknown to most, the vehicle's dead battery must be completely removed and the camper's battery substituted therefor in order to safely and successfully start the vehicle.

Several dual battery systems have been patented that can selectively operate the electrical system of the vehicle or the camper from either of the two batteries. These patented systems are fairly elaborate and none of them is known to be commercially available. Further, none of them teaches a way to easily and safely modify vehicle-camper outfits and the like that are commercially available in order to connect the camper's battery to the starter motor of the vehicle should the vehicle's battery fail. U.S. Pat. No. 3,763,415 to Ownby issued on Oct. 2, 1973, discloses a dual battery system with a switch 55 mounted inside the vehicle for selectively connecting battery B-1 or B-2 to the electrical system of either the vehicle or the accessory. Ownby's device is fairly elaborate and limited to his own system. To switch from one battery to the other requires the operation of switch 55, rectifiers 56 and 57, solenoid switch 58, and an indicator light 59 (see line 13–16 of column 4 of his patent). Ownby's teaching is not easily adapted to commercially available vehicle-camper outfits. U.S. Pat. No. 2,085,275 to Schmidt issued June 29, 1937, discloses a dual battery system which requires operation of a plurality of switches (switch 38, switch 50, and switch 27 with terminals 54 and 55 connected to terminals 29 and 49) to connect the auxiliary battery to the vehicle's starter system. U.S. Pat. No. 3,949,289 to Day issued Apr. 6, 1976 discloses a dual battery system which also requires operation of a plurality of switches 20, 34, and 48 to selectively connect either battery to the electrical system of the vehicle or the camper. Day's approach also involves the necessity of relays 14 and 46. U.S. Pat. No. 2,913,587 issued to Gebhard on Nov. 17, 1959, uses two batteries to start his vehicle. Gebhard's second battery is not connected to a second electrical system. Further, Gebhard's switch 104 offers no obstacle to a potential thief. U.S. Pat. No. 3,806,790 to Marshall issued Apr. 23, 1974, and U.S. Pat. No. 3,829,753 to Marshall issued Aug. 13, 1974 illustrate charger systems for vehicles with dual batteries. Such charger systems are very sensitive and are usually completely burned out by any attempt to join the two batteries with jumper cables should one of the batteries fail.

No prior approach combining theft prevention features and battery switching features is known to exist. The present invention offers such an approach in a low cost and simply constructed device that can be easily installed in commercially available vehicle-camper outfits.

SUMMARY OF THE INVENTION

This invention involves a theft prevention switch device for use in a vehicle with an electrical system that operates off a single battery source or one of a plurality of battery sources. For an electrical system operating off a single battery source, the device includes a first electrical conducting means connected to the electrical system of the vehicle. The two electrical conducting means are spaced from each other within a box-like enclosure and a portable, removable plunger can be connected between the two electrical conducting means to electrically connect the battery source to the electrical system of the vehicle. The plunger in this embodiment has a flat portion and a cylindrical, gripping member attached thereto. The gripping member is electrically insulated and a finger can be inserted into the gripping member for easy manipulation of the plunger. The enclosure has a moveable lid that can be locked shut. In operation, the plunger can be removed and the enclosure locked to prevent access to a thief. The thief could, of course, work around the device but it would involve raising the hood of the vehicle, locating the device, figuring out how it worked, and successfully by-passing it. Time is one of a thief's major obstacles and the time required to locate, figure out, and by-pass the device would probably discourage him. Vehicles without the device would be much easier prey.

Another embodiment of the invention is designed for vehicles with two battery sources. This embodiment is particularly adaptable to commercially available vehicle-camper outfits which have independent electrical systems for the vehicle and the camper, each of which system operates off a separate battery. The theft prevention switch device of this embodiment includes a first electrical conducting means connected to the electrical system of the vehicle, a second electrical conducting means connected to one of the batteries, and a third electrical means connected to the other battery. All three electrical conducting means are mounted within a box-like enclosure which has a moveable lid that can be locked shut. A plunger for selectively connecting said first electrical conducting means is provided. The plunger has two substantially planar portions joined at an angle. The three electrical conducting means are attached to a support member within the box-like enclosure and are spaced from each other about a common point. Planes or lines extending from the common point out to each electrical conducting means intersect at angles. The angle between the planes or lines to the first and second electrical conducting means is substantially the same as the angle between the two planar portions of the plunger. The same is true for the angle between the lines or planes to the first and third electrical conducting means. The plunger has an insulated, cylindrical gripping member for easy insertion of a finger and each manipulation of the plunger from a first position connecting said first and second electrical conducting means and a second position connecting said first and third electrical conducting means. The plunger is easily moved from its first position to its second position by reversing the planar portion connected to the first electrical conducting means. The second planar portion is then automatically in alignment with the third electrical conducting means. Each electrical conducting means includes a pair of U-shaped members supported to form an M. Each planar portion of the plunger is slidably receivable between the inner two members of the M. As in the first embodiment, the plunger can be removed and the enclosure about the three electrical conducting means locked shut to prevent access thereto. In both embodiments, the time required to locate, figure out, and by-pass the device would probably discourage most thieves.

OBJECTS OF THE INVENTION

It is an object of this invention to provide a new and novel theft prevention switch device for use in a vehicle having an electrical system operable off a single or a dual battery source.

It is also an object of this invention to provide a new and novel theft prevention switch device that is simple in design, inexpensive to make, and easily installed in commercially available vehicles.

It is an object of this invention to provide a new and novel device for quickly and easily connecting an electrical system to alternate power sources.

It is also an object to provide a device that combines anti-theft features with switching features.

Additional objects and advantages of the invention will become apparent from the following specification and accompanying drawings.

DETAILED DESCRIPTION OF THE PREFERRED EMBODIMENTS

Figure 1:
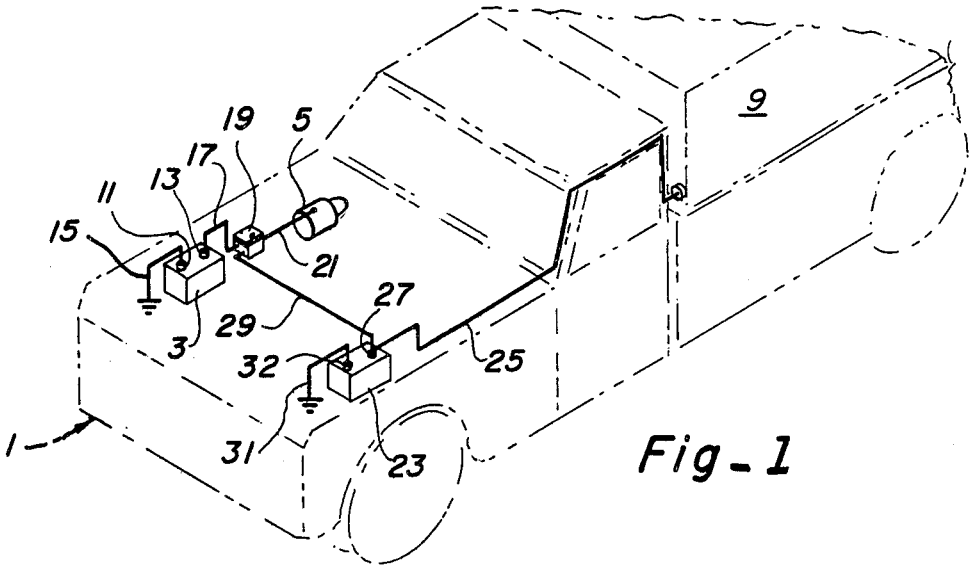
FIG. 1 is a perspective view of the device of the present invention in use in a vehicle which has a separate battery system for a camper.

As best seen in FIG. 1, the vehicle 1 has a primary battery source 3 for its starter motor 5. The battery 3 has negative and positive poles 11 and 13. The negative pole 11 is grounded to the body of the vehicle 1 by line 15. The positive pole 13 is connected by line 17 to the theft prevention switch device 19 which is connected by line 21 to the starter 5.

Secondary battery 23 is mainly used to supply electrical power through line 25 to a camper 9 or other accessory. Line 25 is connected to the positive pole 27 of the battery 23 as is line 29 which connects the positive pole 27 to the theft prevention switch device 19. Ground line 31 connects the negative pole 32 of the battery 23 to the body of the vehicle 1.

Figure 2:
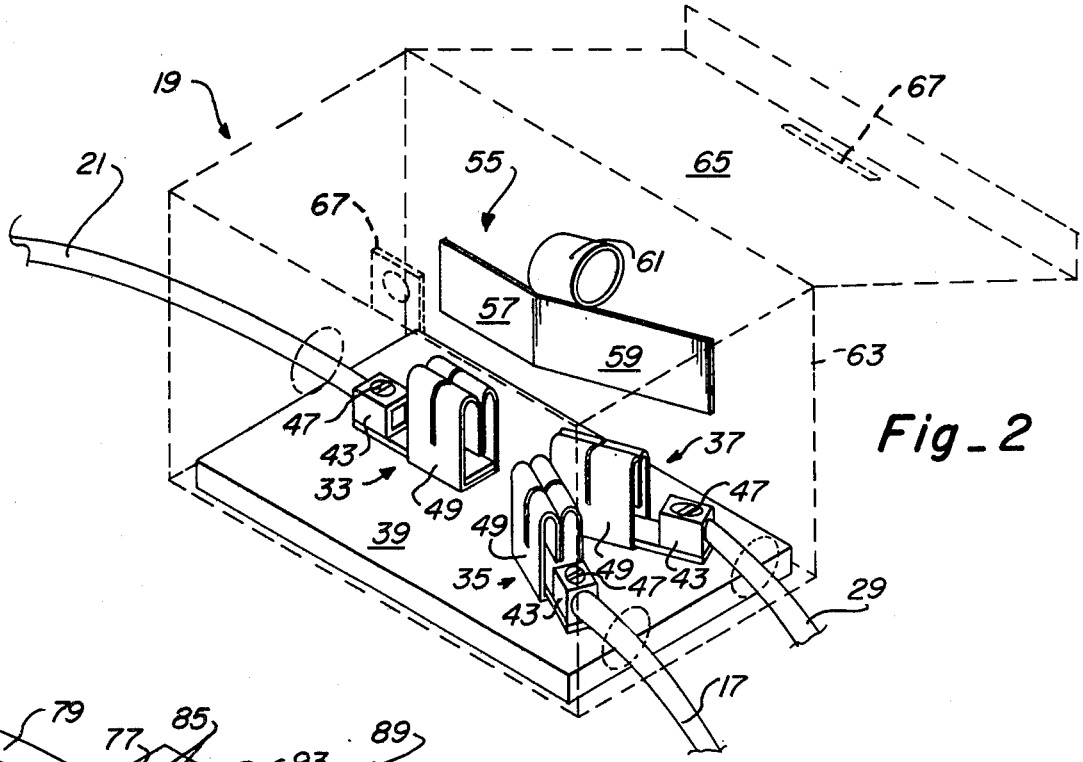
FIG. 2 illustrates the components of the device of FIG. 1. The device of this embodiment has first, second, and third electrical conducting means positioned within a box which can be locked shut. The plunger is portable and removable to disconnect the electrical system of the vehicle from the battery sources.
Figure 4:
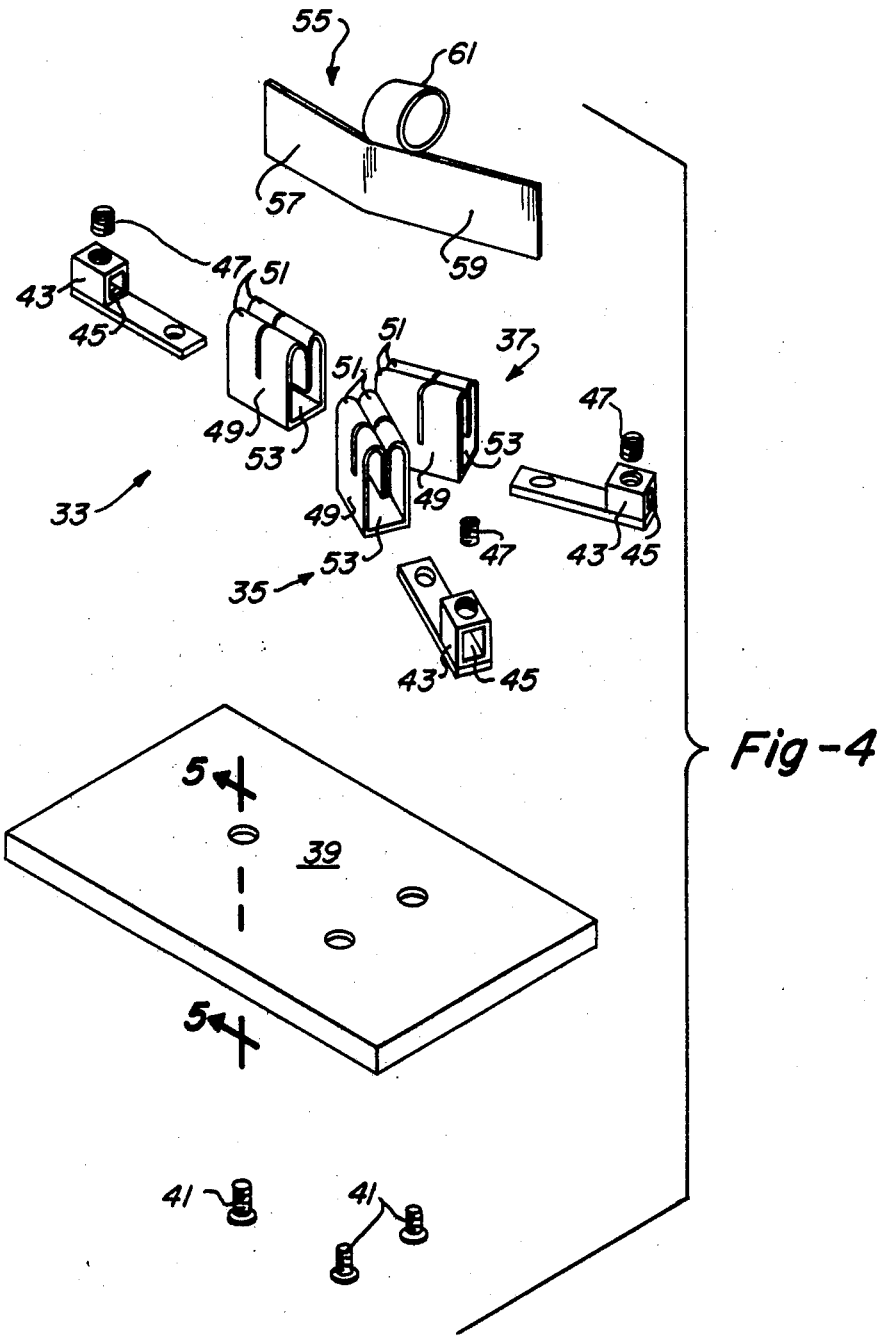
FIG. 4 is an exploded view of the theft prevention switch device of FIG. 2.
Figure 5:
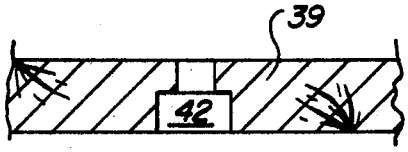
FIG. 5 is a view along line 5—5 of FIG. 4 showing one of the recessed portions of the support plate. These portions are designed to receive the heads of the screws that attach the three electrical conducting means to the plate.

Referring to FIGS. 2, 4, and 5, the preferred theft prevention switch device 19 has three electrical conducting means 33, 35, and 37 mounted to a support plate 39 by screws 41 which are received in recesses 42 of support plate 39 (see FIGS. 4 and 5). The support plate 39 is made of an insulating material such as wood, masonite, and the like. The first electrical conducting means 33 is connected to line 21 leading to the starter 5 of the electrical system of the vehicle 1. The second and third electrical conducting means 35 and 37 are respectively connected to lines 17 and 29 which lead to the positive poles 13 and 27 of the two batteries 3 and 23. Each line connector 43 has a bore 45 to receive a line and a screw 47 to maintain the line in the bore 45. The screws 47 can be turned to penetrate any insulation about the lines and make a good electrical connection.

Each electrical conducting means as shown in FIG. 4 has a means 49 composed of to two substantially U-shaped members 51 supported by the base member 53 to form an M shape. The plunger means 55 has two substantially planar portions 57 and 59 joined at an angle. The plunger means 55 also has a cylindrical gripping member 61 for easy manipulation of the plunger means 55. A finger can be easily inserted into the gripping member 61 or the gripping member 61 can be seized between two or more fingers to manipulate the plunger means 55. For safety, the gripping member 61 can be insulated. Each planar portion 57 or 59 of the plunger means 55 is slidably receivable between the inner two members of the M of each means 49 to form an electrical connection.

The electrical conducting means 33, 35, and 37 are spaced from each other about a common point. The three electrical conducting means 33, 35, and 37 are attached to the support plate 39 so that planes or lines extending from the common point and intersecting the inner two members of the M of the electrical conducting means 35 and 37 will intersect a corresponding plane or line extending from the common point to the electrical conducting means 33 at an angle substantially equal to the angle between the planar portions 57 and 59 of the plunger means 55.

In operation, the plunger means 55 can be positioned to connect the first electrical conducting means 33 and the second electrical conducting means 35 to join the starter motor 5 of the electrical system of the vehicle 1 to the first battery source 3. In this first position, planar portion 59 of the plunger means 55 is slidably received between the inner two members of the M of the first electrical conducting means 33 and planar portion 57 is slidably received in the M of the second electrical conducting means 35. Should the first battery 3 fail, the plunger means 55 can be easily manipulated as shown in FIG. 2 to join the first and third electrical conducting means 33 and 37 to connect the starter motor 5 of the electrical system of the vehicle 1 to the second battery source 23. This can be done by merely lifting the plunger means 55 and moving it to insert the first planar portion 57 in the M of the first conducting means 33 and the second planar portion 59 in the M of the third electrical conducting means 37. Placement of the three electrical conducting means 33, 35 and 37 at angles corresponding to the angle between the planar portion 57 and 59 of the plunger means 55 makes this a simple and quick procedure.

Another element of the invention is box 63 which has a lid 65 and lock means 67. The three electrical conducting means 33, 35, and 37 are supported on plate 39 within the box 63. By removing the plunger means 55 and locking the box 63 shut, a thief not only has to take time to break into the box 63 but also has to take time to figure out how the theft prevention device works and how to by-pass it. This additional time that must be spent to overcome the theft prevention device will most likely discourage a thief since time is one of his major concerns.

Figure 3:
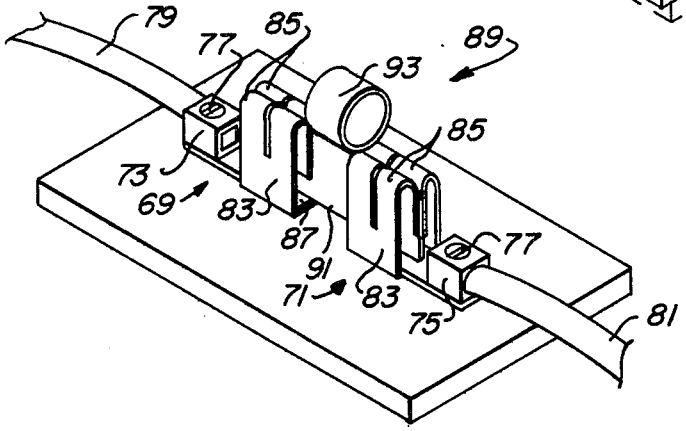
FIG. 3 illustrates an embodiment of the invention adapted for use in electrical systems that are operable off a single battery source.

FIG. 3 illustrates an embodiment of the invention for use in vehicles which have electrical systems operating off one battery. The theft prevention device of FIG. 3 has two electrical conducting means 69 and 71. Each electrical conducting means 69 and 71 has a line connector 73 and 75 with a bore and screw 77 to receive either the line 79 to the starter motor 5 of the electrical system of the vehicle or the line 81 to the battery. The lines 79 and 81 can be bared at the line connectors 73 and 75 or the screws 77 can be turned to penetrate any insulation and make a good connection. As in the embodiment of FIGS. 2 and 4, each electrical conducting means 69 and 71 has a means 83 composed of two substantially U-shaped members 85 supported by the base member 87 to form an M shape. The plunger means 89 in this embodiment has a flat member 91 and a cylindrical gripping member 93. For safety, the gripping member 93 can be insulated. A finger can be inserted into the gripping member 93 or the gripping member 93 can be seized between two or more fingers for easy manipulation of the plunger means 89. The electrical conducting means 69 and 71 of this embodiment are also designed to be placed in a box that can be locked shut. By removing the plunger means 89 and locking the box, a thief must not only spend time breaking into the box but also must take time to figure out how the device works and how to by-pass it. As with the other embodiment of this invention, this extra time would probably discourage most thieves.

The embodiment of FIGS. 2 and 3 can be used in combination. The additional time required to find and by-pass two separate theft prevention devices would further discourage any potential thief.

While two embodiments of the present invention have been described in detail herein, various changes and modifications may be made without departing from the scope of the invention.

I claim:

1. A theft prevention apparatus for a vehicle having an electrical system selectively operable off one of at least two battery sources, said apparatus comprising:

first electrical conducting means operably connectable to said electrical system, second electrical conducting means operably connectable to said first battery source, third electrical conducting means operably connectable to said second battery source, support means including a first member and means to attach said first, second, and third electrical conducting means to said first member in a predetermined relationship in which each electrical conducting means is spaced from the other two, removable means for selectively connecting said first electrical conducting means to said second and third electrical conducting means, said removable means being portable and removable from each of said first, second, and third electrical conducting means whereby said electrical system can be made inoperable by removing said removable means to prevent theft of the vehicle, said removable means having two substantially planar portions joined at an angle, and, said attaching means of said support means attaching said first, second, and third electrical conducting means to said first member in positions spaced from each other about a common point whereby a first plane extending between said second electrical conducting means and said common point and a second plane extending between said third electrical conducting means and said common point each intersect a third plane extending between said first electrical conducting means and said common point at an angle substantially the same as the angle between said two substantially planar portions of said removable means, said removable means being easily movable between a first position in which one planar portion of the removable is connected to the first electrical conducting means and the other planar portion is connected to the second electrical conducting means and a second position in which said one planar portion is connected to the third electrical conducting means and said other planar portion is connected to said first electrical conducting means.

2. The theft prevention apparatus of claim 1 wherein: said first, second, and third electrical conducting means each have means to slidable receive one of said portions of said removable means.

3. The theft prevention apparatus of claim 2 wherein: said removable means includes grip means operably connected to said two planar portions for easy manipulation thereof.

4. The theft prevention apparatus of claim 3 wherein: said grip means is electrically insulated for safety.

5. The theft prevention apparatus of claim 3 wherein: said grip means is substantially cylindrical for easy insertion of a finger to manipulate said two planar portions.

6. The theft prevention apparatus of claim 1 wherein: each of said first, second, and third electrical conducting means includes a pair of substantially U-shaped conducting members and means to support said substantially U-shaped members to form an M shape, each of said two planar portions of said removable means being selectively slidably receivable between the inner two members of the M of each of said first, second and third electrical conducting means to form an electrical connection therewith.

7. The theft prevention apparatus of claim 1 further including means for enclosing said first, second, and third electrical conducting means, said enclosing means having means movable from a closed position preventing access to the interior of said enclosing means to an open position providing access to the interior thereof, said enclosing means further including lockable means for preventing movement of said movable means away from said closed position.

8. The theft prevention device of claim 1 wherein said electrical system includes a starter motor and said first electrical conducting means is operably connectable to said starter motor.

9. A theft prevention apparatus for a vehicle having an electrical system selectively operable off one of at least two battery sources, said apparatus comprising:

first electrical conducting means operably connectable to said electrical system, second electrical conducting means operably connectable to said first battery source, third electrical conducting means operably connectable to said second battery source, each of said electrical conducting means being spaced from the other two, and, removable means for selectively connecting said first electrical conducting means to said second and third electrical conducting means, said removable means being portable and removable from each of said first, second, and third electrical conducting means whereby said electrical system can be made inoperable by removing said removable means to prevent theft of the vehicle, said removable means including contact means having first and second portions joined at an angle, said removable means further having grip means operably connected to said contact means for easy manipulation of said first and second portions thereof.

10. The theft prevention apparatus of claim 9 wherein said grip means is electrically insulated for safety.

11. The theft prevention apparatus of claim 9 wherein said grip means is substantially cylindrical for easy insertion of a finger to manipulate said removable means.

12. The theft prevention apparatus of claim 9 further including:

support means including a first member and means to attach said first, second, and third electrical conducting means to said first emember in a predetermined relationship in which each of said electrical conducting means is spaced from the other two about a common point whereby lines joining said common point to each respective first, second, and third electrical conducting means form an angle between said respective first and third lines and said respective first and third lines substantially equal to the angle between said first and second portions of said removable means.

13. The theft prevention apparatus of claim 12 wherein:

each electrical conducting means includes means for slidably receiving one of said portions of said contact means of said removable means.

14. The theft prevention apparatus of claim 13 wherein:

each of said means for slidably receiving one of said portions of said contact means includes a pair of substantially U-shaped conducting members and means to support said substantially U-shaped members to form an M shape, one of said portions of said contact means being slidably receivable between the inner two members of each M.

15. The theft prevention apparatus of claim 9 further including:

means for enclosing said first, second, and third electrical conducting means, said enclosing means having means movable from a closed position preventing access to the interior of said enclosing means to an open position providing access to the interior thereof, said enclosing means further including lockable means for preventing movement of said movable means away from said closed position.

16. The theft prevention device of claim 9 wherein said electrical system includes a starter motor and said first electrical conducting means is operably connectable to said starter motor.

17. A theft prevention switch device to be used in combination with two electrical systems designed to be powered independently of each other from two separate battery sources, said device making a first of said two electrical systems selectively operable from either of said two battery sources, said device comprising:

first electrical conducting means operably connected to said first electrical system, second electrical conducting means operably connected to one of said battery sources, third electrical conducting means operably connected to the other of said battery sources, and, removable means for selectively connecting said first electrical conducting means to said second and third electrical conducting means, said removable means being portable and removable from each said first, second, and third electrical conducting means whereby said first electrical system can be selectively operated from either of said two battery sources and said first electrical system can be made inoperable by removing said removable means, said removable means including contact means having first and second portions joined at an angle, said removable means further having grip means operably connected to said contact means for easy manipulation of said first and second portions thereof.

18. The device of claim 17 further including:

support means including a first member and means to attach said first, second, and third electrical conducting means to said first member in a predetermined relationship in which each of said electrical conducting means is spaced from the other two about a common point whereby lines joining said common point to each respective first, second, and third electrical conducting means from an angle between said respective first and third lines and said respective first and third lines substantially equal to the angle between said first and second portions of said removable means.

19. The device of claim 17 wherein:

each electrical conducting means includes means for slidably receiving one of said portions of said contact means of said removable means, each of said means for slidably receiving one of said portions of said contact means includes a pair of substantially U-shaped conducting members and means to support said substantially U-shaped members to form an M shape, one of said portions of said contact means being slidably receivable between the inner two members of each M.

20. The device of claim 17 further including:

means for enclosing said first, second, and third electrical conducting means, said enclosing means having means movable from a closed position preventing access to the interior of said enclosing means to an open position providing access to the interior thereof, said enclosing means further including lockable means for preventing movement of said movable means away from said closed position.

21. The device of claim 17 wherein said first electrical system includes a starter motor and said first electrical conducting means is operably connectable to said starter motor.

22. A switch apparatus for selectively operating an electrical system off one of at least two electrical sources, said switch apparatus comprising:

first electrical conducting means operably connectable to said electrical system, second electrical conducting means operably connectable to one of said electrical sources, third electrical conducting means operably connectable to the other of said electrical sources, each of said electrical conducting means being spaced from the other two, and, removable means for selectively connecting said first electrical conducting means to said second and third electrical conducting means, said removable means including contact means having first and second portions joined at an angle, said removable means being portable and removable from each of said first, second, and third electrical conducting means whereby said electrical system can be made inoperable by removing said removable means.

23. The switch apparatus of claim 22 wherein:

said removable means further includes grip means operably connected to said contact means for easy manipulation of said first and second portions thereof.

24. The switch apparatus of claim 23 wherein said grip means is electrically insulated for safety.

25. The switch apparatus of claim 23 wherein said grip means is substantially cylindrical for easy insertion of a finger to manipulate said removable means.

26. The switch apparatus of claim 22 further including:

support means including a first member and means to attach said first, second, and third electrical conducting means to said first member in a predetermined relationship in which each of said electrical conducting means is spaced from the other two about a common point whereby lines joining said common point to each respective first, second, and third electrical conducting means form an angle between said respective first and third lines and said respective first and third lines substantially equal to the angle between said first and second portions of said removable means.

27. The switch apparatus of claim 26 wherein:

each electrical conducting means includes means for slidably receiving one of said portions of said contact means of said removable means.

28. The switch apparatus of claim 26 wherein:

each of said means for slidably receiving one of said portions of said contact means includes a pair of substantially U-shaped conducting members and means to support said substantially U-shaped members to form an M shape, one of said portions of said contact means being slidably receivable between the inner two members of each M.

29. The switch apparatus of claim 22 further including:

means for enclosing said first, second, and third electrical conducting means, said enclosing means having means movable from a closed position preventing access to the interior of said enclosing means to an open position providing access to the interior thereof, said enclosing means further including lockable means for preventing movement of said movable means away from said closed position.

30. A switch device to be used in combination with two electrical systems designed to be powered independently of each other from two separate electric sources, said device making a first of said two electrical systems selectively operable from either of said two electrical sources, said device comprising:

first electrical conducting means operably connected to said first electrical system, second electrical conducting means operably connected to one of said electrical sources, third electrical conducting means operably connected to the other of said electrical sources, and, removable means for selectively connecting said first electrical conducting means to said second and third electrical conducting means, said removable means including contact means having first and second portions joined at an angle, said removable means being portable and removable from each said first, second, and third electrical conducting means whereby said first electrical system can be selectively operated from either of said two electrical sources and said first electrical system can be made inoperable by removing said removable means.

31. The device of claim 30 wherein said removable means further includes grip means operably connected to said contact means for easy manipulation of said first and second portions thereof.

32. The device of claim 30 further including:

support means including a first member and means to attach said first, second, and third electrical conducting means to said first member in a predetermined relationship in which each of said electrical conducting means is spaced from the other two about a common point whereby lines joining said common point to each respective first, second, and third electrical conducting means from an angle between said respective first and third lines and said respective first and third lines substantially equal to the angle between said first and second portions of said removable means.

33. The device of claim 32 wherein:

each electrical conducting means includes means for slidably receiving one of said portions of said contact means of said removable means, each of said means for slidably receiving one of said portions of said contact means includes a pair of substantially U-shaped conducting members and means to support said substantially U-shaped members to form an M shape, one of said portions of said contact means being slidably receivable between the inner two members of each M.

34. The device of claim 30 further including: means for enclosing said first, second, and third electrical conducting means, said enclosing means having means movable from a closed position preventing access to the interior of said enclosing means to an open position providing access to the interior thereof, said enclosing means further including lockable means for preventing movement of said movable means away from said closed position.

* * * * *